US007946574B2

(12) United States Patent
Bauvin et al.

(10) Patent No.: US 7,946,574 B2
(45) Date of Patent: May 24, 2011

(54) SHEET MATERIAL FEEDER

(75) Inventors: Antoine Bauvin, Clichy (FR); Jean-Christian Maleyran, Clichy (FR); Laurent Auffret, Drancy (FR); Francois Reby, Nogent sur Marne (FR); Martyn R. House, Puckeridge (GB); Lee Glover, Sawbridgeworth (GB); Nicholas S Clarke, Harpenden (GB); John D Deamer, Barnston (GB); Mark Woodliffe, Barnston (GB); Matthew A. P. Morrissey, Stevenage (GB)

(73) Assignee: Pitney Bowes Ltd., Harlow, Essex (GB)

( * ) Notice: Subject to any disclaimer, the term of this patent is extended or adjusted under 35 U.S.C. 154(b) by 1652 days.

(21) Appl. No.: 11/033,950

(22) Filed: Jan. 12, 2005

(65) Prior Publication Data

US 2006/0151938 A1 Jul. 13, 2006

(51) Int. Cl.
*B65H 1/00* (2006.01)

(52) U.S. Cl. ..... 271/161; 271/145; 271/126

(58) Field of Classification Search ..... 271/3.08, 271/126, 145, 161
See application file for complete search history.

(56) References Cited

U.S. PATENT DOCUMENTS 1,684,741 A * 9/1928 Nitsch et al. ..... 271/95
1,685,799 A * 10/1928 Baker ..... 271/148
2,991,075 A * 7/1961 Wheeler et al. ..... 271/161
3,287,014 A * 11/1966 Pasquinelli ..... 271/248
3,525,517 A * 8/1970 Toby ..... 271/117
3,720,407 A * 3/1973 Woodward ..... 271/161
4,172,592 A * 10/1979 Mueller et al. ..... 493/413
4,226,410 A * 10/1980 McIntosh et al. ..... 493/410
4,631,552 A * 12/1986 Kobayashi ..... 346/136
4,934,687 A * 6/1990 Hayden et al. ..... 271/202
4,941,654 A * 7/1990 Kelley ..... 271/209
5,364,087 A * 11/1994 Schieck et al. ..... 271/148
5,472,183 A * 12/1995 Kubo ..... 271/9.03
5,605,528 A * 2/1997 Larson ..... 493/411
5,700,006 A * 12/1997 Sekiya et al. ..... 271/241
6,283,469 B1 * 9/2001 Weber ..... 271/148
6,352,256 B1 * 3/2002 Hsieh ..... 271/110
2002/0158405 A1 * 10/2002 Nagasako et al. ..... 271/213

* cited by examiner

*Primary Examiner* — Stefanos Karmis
*Assistant Examiner* — Howard Sanders
(74) *Attorney, Agent, or Firm* — Brian A. Collins; Charles R. Malandra, Jr

(57) ABSTRACT

A sheet stacking apparatus for storing a plurality of sheets is disclosed having a storage chamber having a first transverse dimension, a platform located within the storage chamber for storing a plurality of sheets in a substantially vertical stack thereon, a feeder for feeding a top sheet from the stack, and means for moving the platform upwards to hold the stack in operative contact with the feeder, wherein the platform comprises a support portion having a second transverse dimension which is less than the first transverse dimension, for allowing sheets stacked on the platform to droop below the support portion in at least one overhanging region.

17 Claims, 9 Drawing Sheets

SHEET MATERIAL FEEDER

FIELD OF THE INVENTION

This invention relates to an apparatus and method for feeding sheet-like material to a sheet handling apparatus. More particularly, the apparatus and method of the present invention relate to the feeding of thin sheet-like material at a high rate-of-feed and for sheet material having bulky, curly, folded or distorted shape.

BACKGROUND OF THE INVENTION

Many different types of sheet handling apparatus are known for performing a range of different operations on sheet-like material. Especially, many paper-handling devices are known, such as printers, photocopiers and folder/inserter machines. In these devices, a plurality of sheets are stored, often in a stack, until such time as the sheets are required for a sheet-handling operation. The sheets are then fed one-at-a-time into the sheet handling apparatus from the stack, and passed to an appropriate machine location where the sheet handling operation is performed.

In a simple sheet feeder, sheets are fed from the top or bottom of a stack of sheets by a pre-feed roller. The pre-feed roller engages the top or bottom sheet and feeds it towards the sheet handling apparatus. Typically, the feeding operation causes a shingling effect, whereby pre-feeding the top sheet simultaneously causes several further sheets to be fed due to frictional contact between the adjacent sheets. This shingling effect creates an overlapping system of sheets being fed into the sheet handling apparatus. In order to ensure that sheets are fed one-at-a-time to the sheet handling apparatus, the sheet feeder is further provided with a separator system. Such systems typically comprise a separator roller, which continues to feed the sheets received from the pre-feed system, and a separator pad or stone located opposite the separator rollers for retarding any further sheets, thereby allowing only a single sheet to pass under the feeding action of the separator roller.

However, such a simplistic sheet feeder is not always appropriate. For example, when a plurality of envelopes or folded or stapled sheets is stacked in a vertical stack (i.e. when each sheet-like element is substantially in a horizontal plane with adjacent sheet members located above and below it) then the sheet-like material does not form an ordered stack. This can lead to a stack of sheet-like material which is curled either in the corners or around the edges due to the extra thickness of folded, stapled or seam portions. This can present problems since when such a curled stack becomes large it is impossible for a typical sheet feeder to correctly engage the sheets in the stack in order to feed them into the sheet handling apparatus. Due to the uneven manner in which contact is made with the top sheets in the stack, the sheet being fed may become twisted or skewed as it is fed into the sheet handling apparatus, leading to damaged sheet material or a machine jam.

In prior art devices, bulky or awkward materials are traditionally stacked in a manner designed to reduce the forces acting on the sheet elements. Typically, sheet material such as envelopes are formed into a near-horizontal stack (i.e. with each envelope lying substantially in a vertical plane with adjacent envelopes located in front of and behind it). The front envelope in the stack is then engaged by feed rollers which rotate to feed the envelope down and forwards into a horizontal configuration before feeding the envelopes into the sheet handling apparatus. Such an arrangement reduces compressive forces between the envelopes, hence reducing shingling or envelope damage, but is costly in terms of the size of the stacking tray required to hold a sufficient plurality of envelopes, or is otherwise limited by the envelope stacking system having only a small capacity.

Alternatively, top-feeder devices may be used for envelopes, but these encounter limitations. Top feeders have the problem that material is presented to the feed element in a non-uniform manner, as thin material stacks (above 100 envelopes) can present extremely curled profiles at the top of the stack (the material which will be fed first). This is especially apparent with envelopes, considered to be the worst-case material to feed, as there are so many different types, each with different weights and constructions. As such, existing top feeders remove this element of variability by limiting the stack height, allowing only low capacities (typically only 100 pieces as a maximum). Even then, the performance of these feeders is still questionable.

Such envelope feeders are mainly, although not exclusively, used on folder/inserter machines for automatically feeding sheet material, in various forms, into envelopes which are held open ready to receive the desired contents. Typically, such a folder/inserter has means for storing a plurality of sheets forming the pages of a mail document. These pages are fed into the folder/inserter machine where they are folded automatically and then inserted into a waiting envelope. The envelopes are held in an envelope feeder section of the machine from which they are transported to an insertion location to await receipt of the folded mail package. The envelope and contents are then fed through an envelope sealing section of the machine before being ejected into a receive tray or bin.

Traditionally, the use of such folder/inserter machines has been dominated by large organizations, for instance banks, utilities companies and Governments, who require a means for producing a large number of mailpieces addressed to specific individuals and each containing unique printed material therein, potentially private to the recipient. Machines employed for these purposes are typically extremely large, and operate at a very high throughput, i.e. they produce mailshots potentially comprising hundreds of thousands of individually-addressed mailpieces in a short amount of time. Organizations having a national or international audience might need to produce hundreds of thousands of such mailpieces in a single day.

However, folder/inserter machines are rapidly becoming more widely accepted amongst medium and small-sized businesses. Such businesses still require the capacity to produce a large amount of outgoing mail, but to a smaller audience. Further, such businesses are incapable of affording the associated costs of running and operating a highly complex mailing apparatus of the type used by large organizations. Instead, folder/inserter machines of reduced complexity, and of a size suitable for SOHO (small office/home office) operation have been developed. Such machines are typically capable of producing mailshots comprising from a few hundred to one or two thousand mailpieces. These machines must be able to readily accept paper in the size and format typically used within an office environment, and similarly must be able to store and fill envelopes of the types most commonly used in the SOHO environment. Therefore, a folder/inserter for the SOHO environment will typically have an envelope feeding mechanism capable of storing several hundred envelopes in a stack. These envelopes are subsequently fed to a feeder/separator which separates a single envelope from the stack and feeds it to a waiting position where the envelope is held open and the desired printed material is inserted thereinto, as described above.

A balance has, therefore, existed in prior art machines between the necessity, on the one hand, to provide a sufficient quantity of envelopes without constantly stopping operation to replenish the supply, and the desire, on the other hand, to provide the envelopes one-at-a-time at a high rate-of-feed without unduly increasing the size of the envelope feeder to accommodate increased storage (in particular the size of the feeder "footprint" which effectively determines the actual space occupied).

SUMMARY OF THE INVENTION

According to a first aspect of the present invention, there is provided a sheet stacking apparatus for storing a plurality of sheets, comprising: a storage chamber having a first transverse dimension; a platform located within the storage chamber for storing a plurality of sheets in a substantially vertical stack thereon; a feeder for feeding a top sheets from the stack; and means for moving the platform upwards to hold the stack in operative contact with the feeder; characterized in that the platform comprises a support portion having a second transverse dimension which is less than the first transverse dimension, for allowing sheets stacked on the platform to droop below the support portion in at least one overhanging region.

According to a second aspect of the present invention, there is provided a method of supplying sheets to a sheet handling apparatus, comprising the steps of: (a) providing a plurality of sheets in a stack on an upper surface of a platform; (b) engaging the upper sheet in said stack with a feed system; and (c) feeding a top sheet from said stack to the sheet handling apparatus, the method being characterized by supporting the stack of sheets under a first portion of the surface area of the bottom sheet; and allowing the remaining portion of the surface area of the bottom sheet to droop.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Referring to FIGS. 1 to 8, the present invention will be described with reference to a single embodiment.

Figure 1:
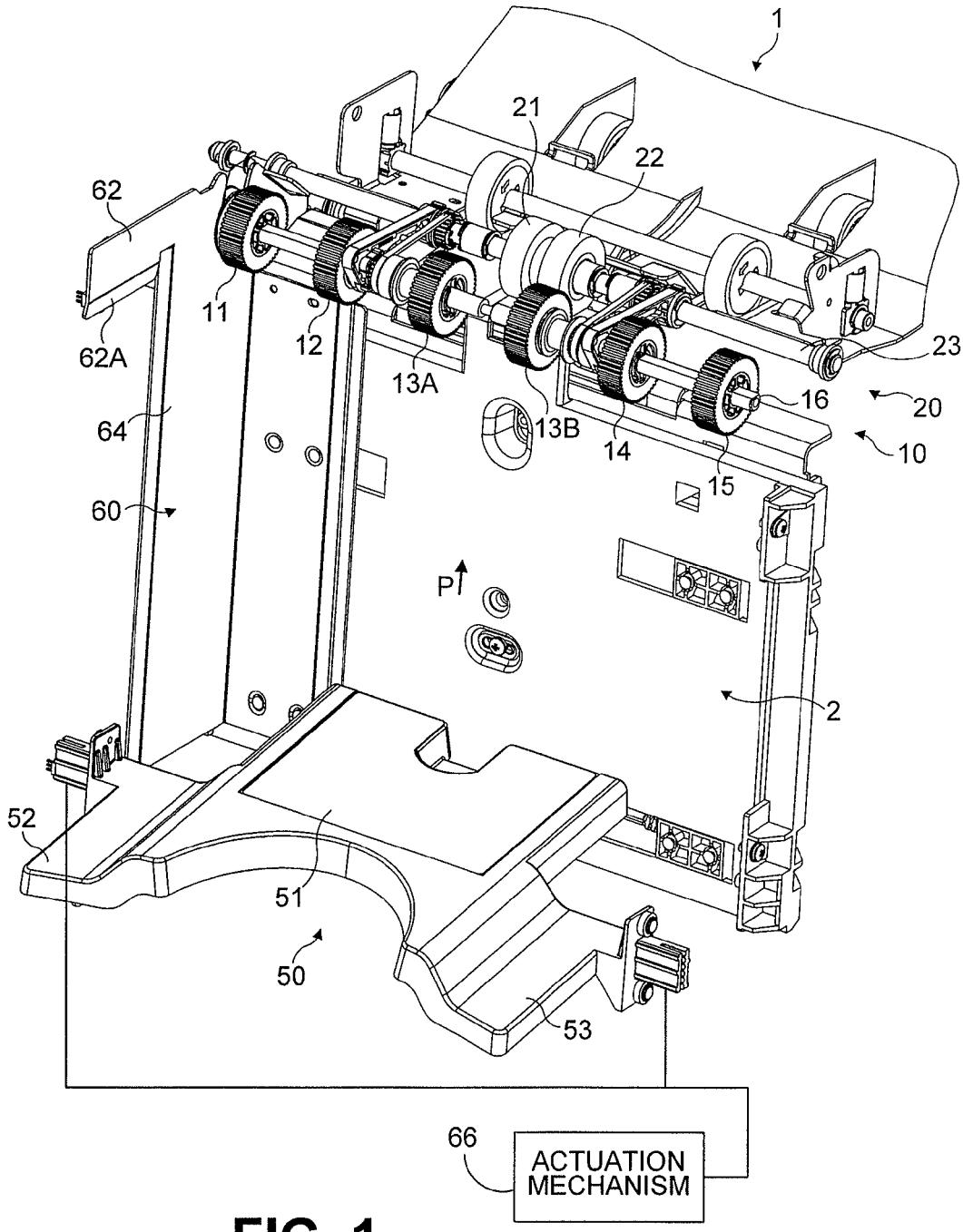
FIG. 1 is a perspective view of a sheet feeder according to an embodiment of the present invention having a lifting platform for a stack of sheets.

As seen in FIG. 1, the sheet feeder comprises a pre-feed system 10 comprising a plurality of rollers 11, 12, 13A, 13B, 14 and 15 mounted on a rotatable shaft 16. Cooperating with the pre-feed system 10 is a separator system 20 comprising a separator shaft 23 on which are mounted separator rollers 21 and 22. Although not shown in the detail in the Figures, a separator pad 29 (FIG. 7) is located opposite and adjacent to the separator rollers 21 and 22 to form a so-called corrugated separator. The pre-feed system 10 is located above a chamber 2 for storing a plurality of sheets therein in a vertical stack.

The chamber 2 is bounded on left and right sides thereof by side guides 60. Throughout the figures, only a single side guide is shown in order to provide clear and unobstructed views of the further components. However, there is a side guide 60 on each side of the storage chamber 2 which guides are mirror images of each other. Each side guide 60 comprises a substantially flat panel extending the height of storage chamber 2 for aligning sheets stacked in the chamber. As can be seen in detail in FIG. 3, each side guide 60 further comprises a funnel section 61 having lower guide members 61A and upper guide members 61B for guiding sheets being fed by the pre-feed system 10 accurately into the separator system 20 at a front end of the side guide 60. At the rear of each side guide 60 are provided back wings 62 for guiding sheets being fed by the sheet feeder by controlling the alignment of the sheets from the rear of each sheet as it is fed by the pre-feed system 10. In use the distance between the side guides 60 may be increased or decreased to alter the width of feed chamber 2, in order to cope with different sizes of sheet to be fed by the feeder.

Located in the storage chamber 2 is a platform 50 for supporting a plurality of sheets to be fed thereon. The platform 50 comprises a narrow lift plate 51 having a width substantially smaller than the width of the storage chamber 2, and depending side sections 52 and 53 for supporting over hanging edges of sheets stored on platform 50. The platform 50 is movable within storage chamber 2 between a full position at the bottom of the storage chamber 2 and an empty position at the top of storage chamber 2, in the direction indicated by arrow P, to allow the platform 50 to move sheets stored thereon towards the pre-feed system 10 as the number of sheets in the stack supported on platform 50 is reduced during operation of the sheet feeder 1.

Figure 9:
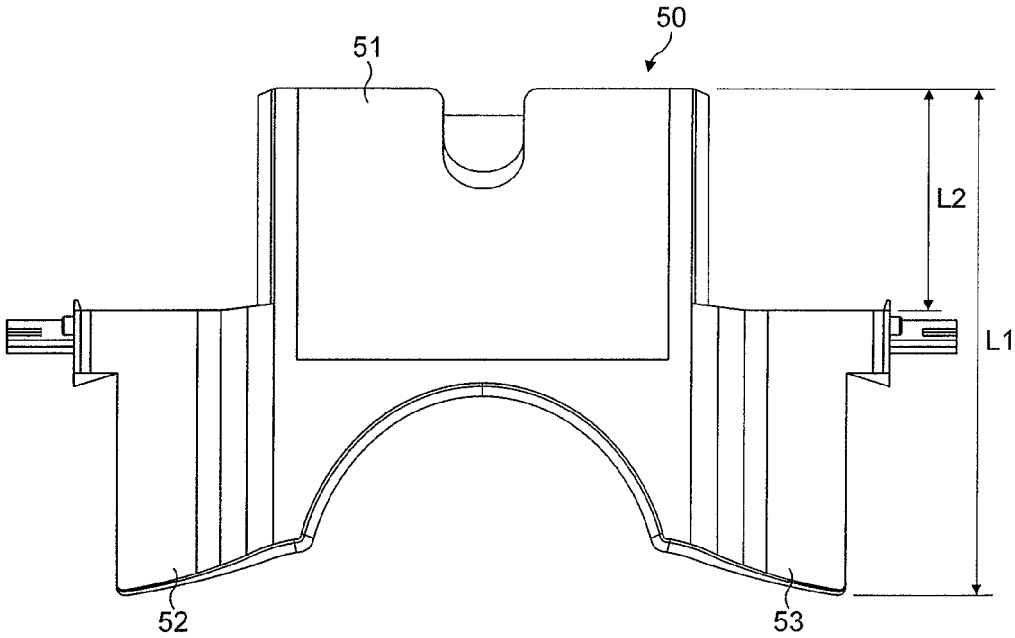
FIG. 9 is a plan view of a support platform forming part of the feeder of FIGS. 1 to 8.
Figure 10:
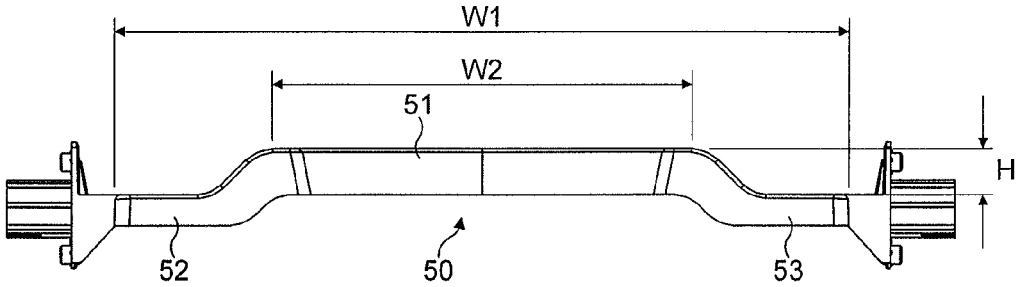
FIG. 10 is a front view of the platform of FIG. 9.

Referring briefly to FIGS. 9 and 10, there is shown in detail the layout of the support platform 50. Platform 50 comprises the lift plate 51 and two lowered side plates 52 and 53. Side regions 52 and 53 are lower than central support region 51 by a height H. In the present embodiment, the height H is 15 mm. At the front edge (top-most in FIG. 9) of the platform 50, the side regions 52 and 53 are not provided, leaving front corner portions unsupported over a distance L2, in this embodiment equal to 71.3 mm. The total available length of the platform 50 is denoted as length L1, in this embodiment equal to 164.2 mm. This allows a large variety of sizes of envelope to be stacked on the platform, and ensures that larger envelopes will be supported, where necessary, at the rear thereof by lowered portions 52 and 53. From FIG. 10, it can be seen that the central platform has a width W2 (=148.9 mm), whilst the total width between the edges of platforms 52 and 53 is W1 (=268.0 mm). These dimensions are selected in order to give a sufficiently large drooping region to a range of sizes of envelopes in the overhang regions H1 and H2 (H1 and H2 are not shown in FIGS. 9 and 10). Not only are the actual dimensions used important for accommodating commonly-found sizes of envelope, but the specific ratios (of L2/L1=0.43 and W2/W1=0.56) are also considered to be important as they accommodate the normal structural ratios of commerciallyavailable envelopes. As can be seen clearly in FIG. 9 (as well as in FIG. 1) the platform 50 is provided with a semi-circular cut-out section. This region makes it easier to load and remove envelopes from the stack supported on the platform 50 during a replenishing operation to supply more envelopes to the sheet feeder apparatus 1.

Figure 2:
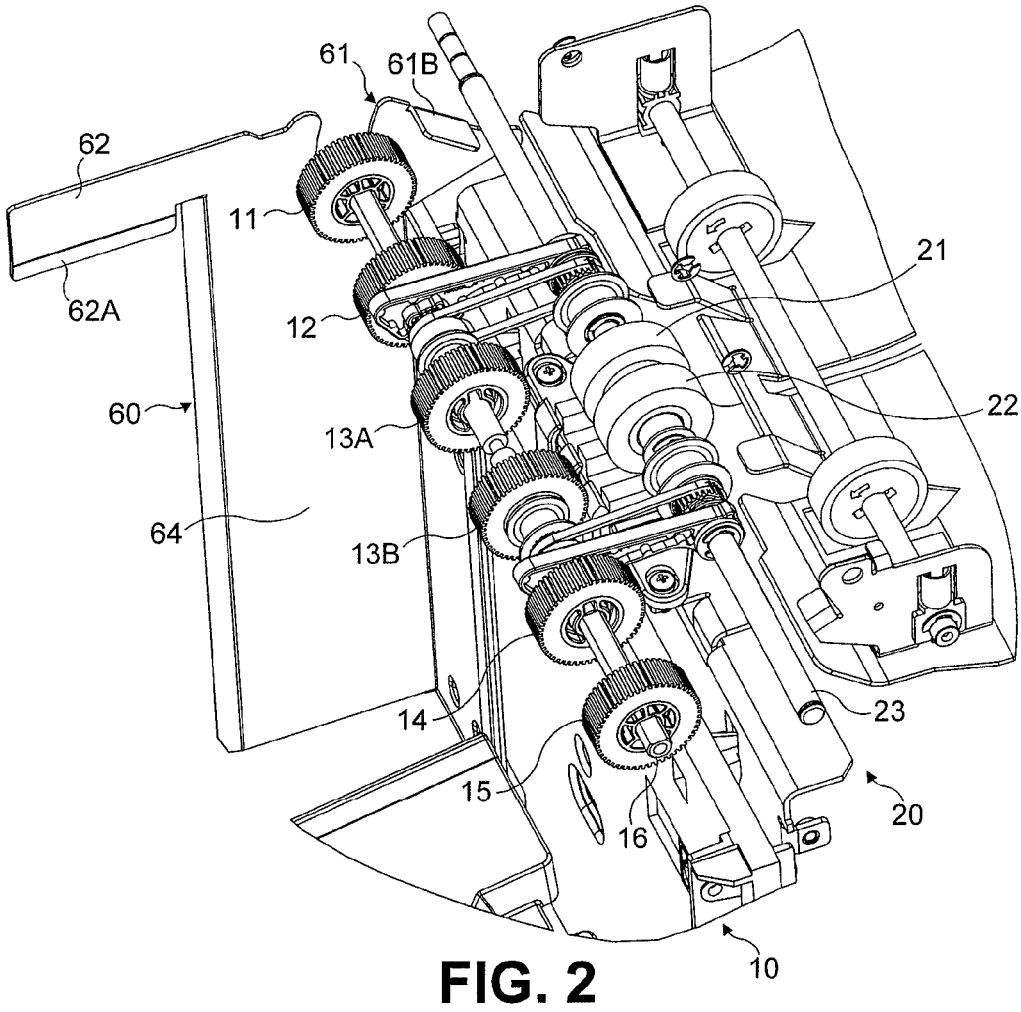
FIG. 2 is a perspective view of the embodiment of FIG. 1, detailing the feeding apparatus for feeding sheets from the sheet feeder.
Figure 3:
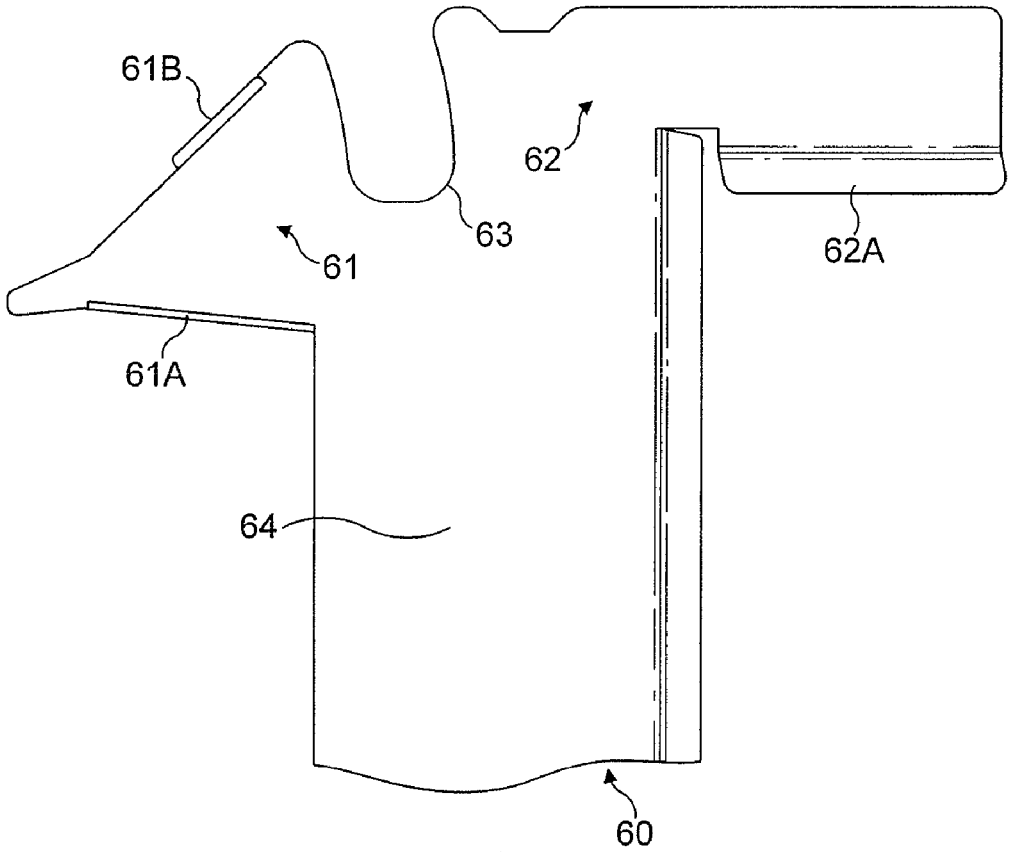
FIG. 3 is a side view of a side guide forming part of the embodiment of FIGS. 1 and 2.

As seen in FIG. 2, the pre-feed system 10 comprises a pre-feed shaft 16 on which are mounted six feed rollers 11, 12, 13A, 13B, 14 and 15. As the platform 50 is raised and sheets are brought into contact with the rollers 11 to 15 of the pre-feed system 10, the rollers 11 to 15 pressingly engage the uppermost sheet in the stack of sheets supported on the platform 50. The pre-feed shaft 16 then rotates in order to feed the top sheet in the stack to the separator section 20. Because the sheets are mounted in a stack, there is frictional contact between the top sheet and the sheets therebelow. As the top sheet is fed from the stack, a plurality of sheets are drawn from the top of the stack along with the top sheet, resulting in a so-called shingling effect.

The sheets removed from the stack are then fed into the separator system 20 comprising separator shaft 23 on which are mounted rollers 21 and 22. The separator system further comprises a separator pad 29 (FIG. 7) formed as a single block having two grooves therein corresponding to the separator rollers 21 and 22, as seen in part in FIG. 7. Thus, as a sheet is fed through the separator, it is forced to curve over the peaks in the separator pad and under the separator rollers (21,22). This results in the sheet adopting a corrugated appearance; hence separators of this type are known in the art as "corrugated separators". Such corrugated separators are particularly useful for feeding envelopes and folded material since they prevent the material becoming bent or distorted by increasing the longitudinal rigidity of the sheet elements being fed as a consequence of the bending of the material as it becomes corrugated.

In order to feed sheets from the stack to the separator 20, it is important that an even normal contact force is maintained at the pre-feed rollers 11 to 15 across the width of the top sheet being fed, so that the sheet will be fed straight into the separator 20 and not become twisted or skewed at an angle. This also helps to achieve a constant drive force on every roller because each roller 11 to 15 now has contact with the correctly profiled material lead edge. This is advantageous as the drive force applied to the material can be accurately varied (increased or decreased as required) to suit different feeding applications (for example different separator technologies, etc.). However, where the sheet material is fed from a particularly curled or distorted stack of sheets, it can be impossible for the pre-feed system 10 to engage the top sheet in the stack in an even manner.

Figure 4:
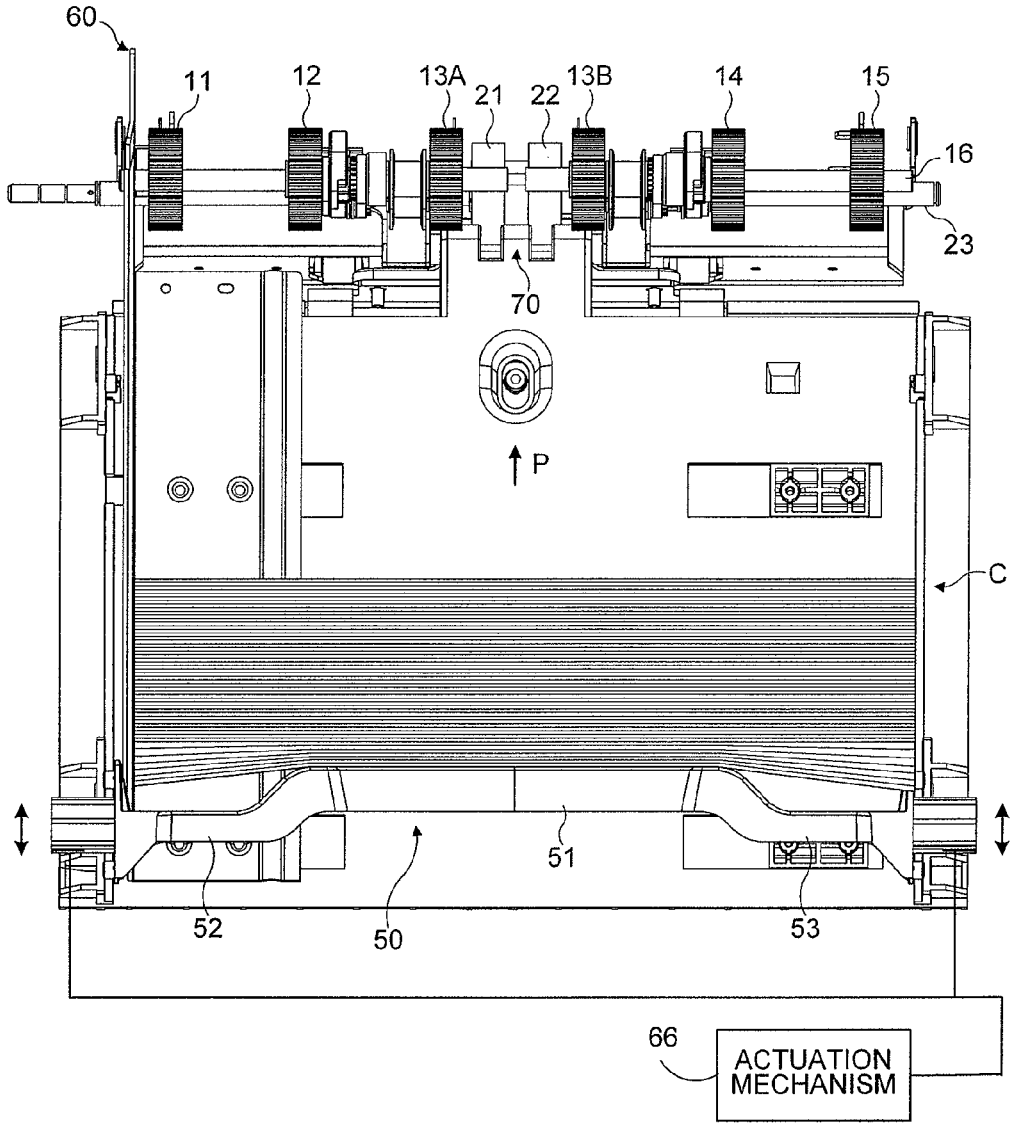
FIG. 4 is a schematic view showing sheet material loaded into the sheet feeder embodiment of FIGS. 1 to 3 before the platform is raised.
Figure 5:
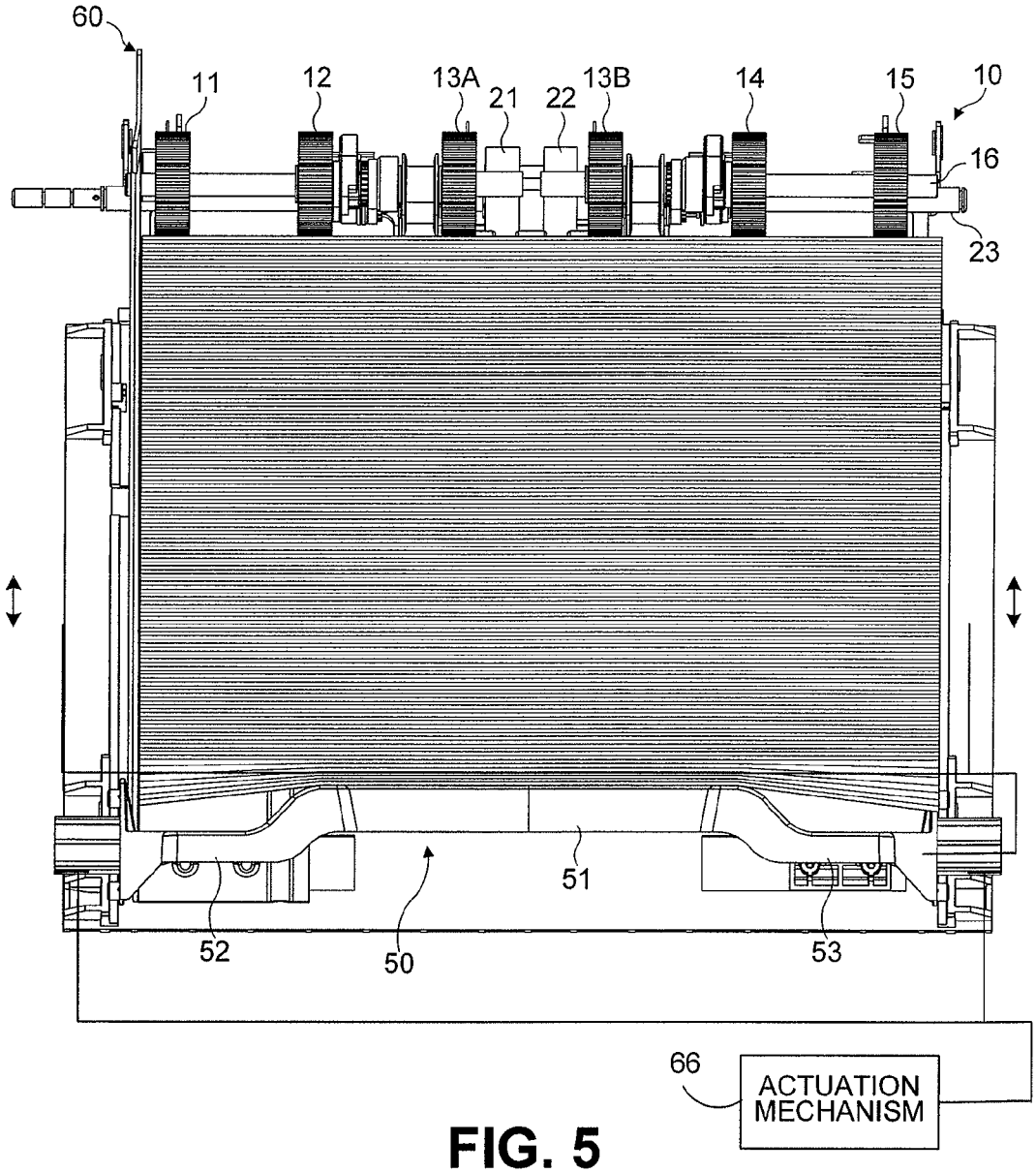
FIG. 5 is a schematic view showing sheet material loaded into the sheet feeder of FIGS. 1 to 4 when in engagement with the feeding mechanism after raising of the platform.
Figure 6:
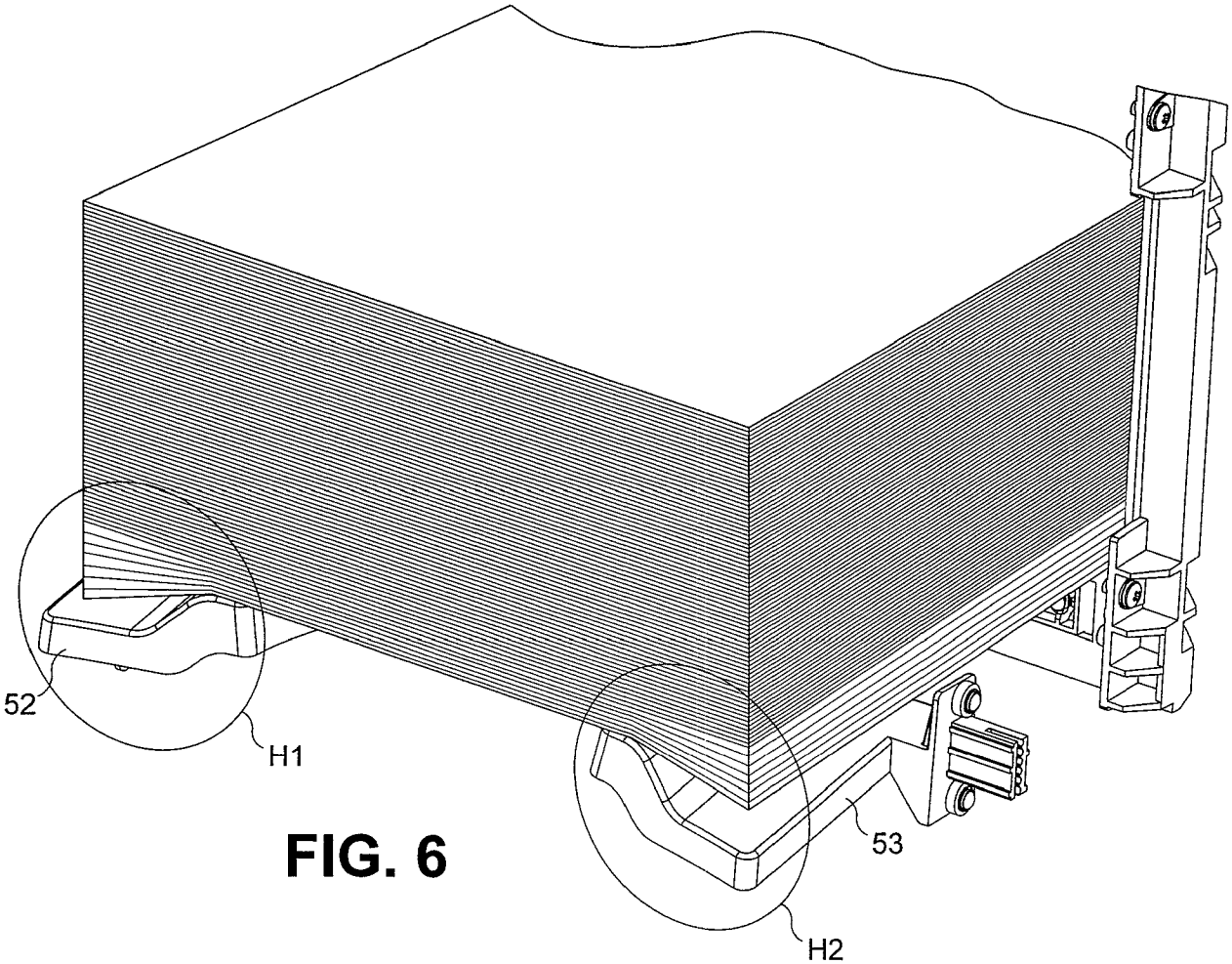
FIG. 6 is a schematic view showing further detail of sheet material loaded into the sheet feeder of FIGS. 1 to 5.
Figure 7:
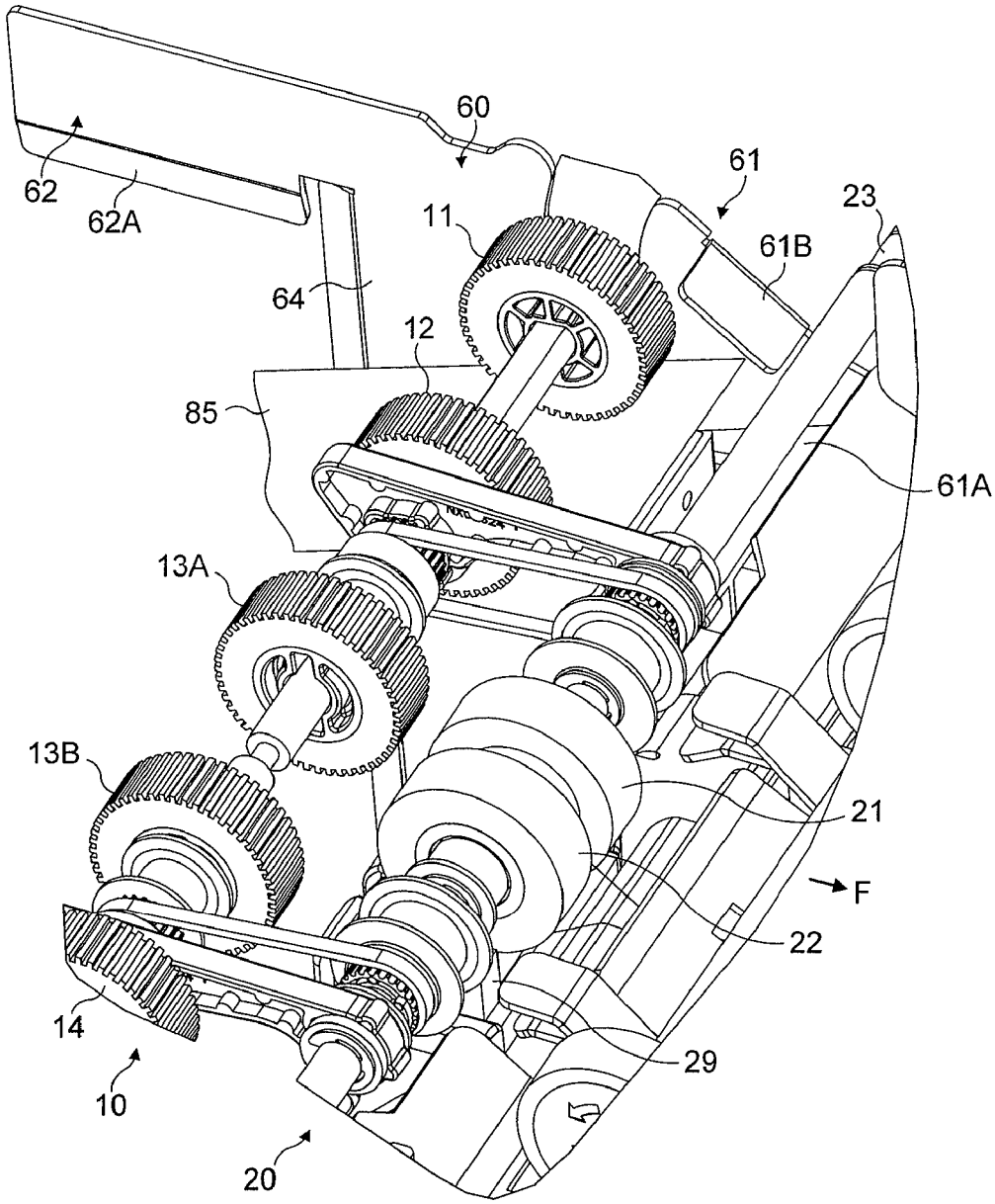
FIG. 7 is a perspective view detailing a sheet being fed by the sheet feeder of FIGS. 1 to 6.

Referring to FIGS. 4 to 6, there is shown in detail the manner in which a plurality of envelopes are stacked upon the platform 50. With an existing platform (supporting the material over its entire surface area), some material stacks (especially envelopes) would present height irregularities at the material lead edge which are impossible to overcome solely by applying only a normal force from the pre-feed system 10. To mitigate against this, platform 50 has a narrow central portion 51 for supporting a plurality of envelopes on the top thereof. The central portion 51 is intentionally made smaller than the envelope being supported. On either side of the central narrow portion 51 there are drooping side portions 52 and 53, which provide rigidity for the platform 50 and further support for the supported sheets, where necessary. The platform has a narrower resting surface (reduced surface area) than the material it has to carry. Therefore, the outer edge or edges of the sheet material will droop below the platform surface, thus reducing the height variations at the top of the stack allowing for a flatter lead edge profile. In other words, the stack of material is effectively levelled at the top of the stack along the leading edge as the thinner central region of the envelopes is supported, whilst the thicker outer regions are allowed to droop. The drooping of the thicker regions of the envelopes at the bottom of the stack compensates for the usual curling effect at the top of the stack where the thicker regions normally overlap to create thick edges, whilst the central region sags to create a bowl-like curve. By intentionally supporting the envelopes only in the thinner region, the sagging effect is effectively inverted, leading to a curled bottom-region of the stack at H1 and H2, but a flat top surface.

As seen in FIG. 4, when a plurality of sheets is first loaded onto the platform 50, they are supported at their central region by the narrow centre portion 51. This allows the envelopes at the bottom of the stack to droop over the side regions 52 and 53 in overhang regions H1 and H2 (see FIG. 6). The provision of overhang regions H1 and H2 reduces the curl experienced at the uppermost sheet in the stack, although there may still be some distortion in curled corner regions C, (as indicated in FIG. 4). The extent of the support which the narrow centre portion 51 provides for the sheets on top thereof can be chosen according to the specific type of sheet material intended to be loaded into the sheet feeder 1. In particular, it is intended that the sheet material to be fed should occupy substantially the entire width of the storage chamber 2 between the side guides 60. The width of central portion 51 relative to the width of the storage chamber 2 can then be selected according to the sheet material to be supported. In the case of an envelope feeder, the width of central portion 51 must be selected according to the intended size of envelope to be used. However, the platform is capable of supporting a range of different types and thicknesses of envelope, whilst still compensating against the curling effect of the envelope stack.

Lowered side portions 52, 53 are connected at the sides of the storage chamber 2 to an actuation mechanism 66 for raising and lowering the platform 50. This mounting location provides stability and rigidity for the platform 50 in order to facilitate raising and lowering the platform in the lift direction P (See FIGS. 1 and 4). Further, it the stacked sheet material droops excessively, for instance if the sheet material is weak or flimsy, it will be supported at the end regions by the lowered side portions 52, 53 to prevent excessive downward curl of the stack.

Figure 8:
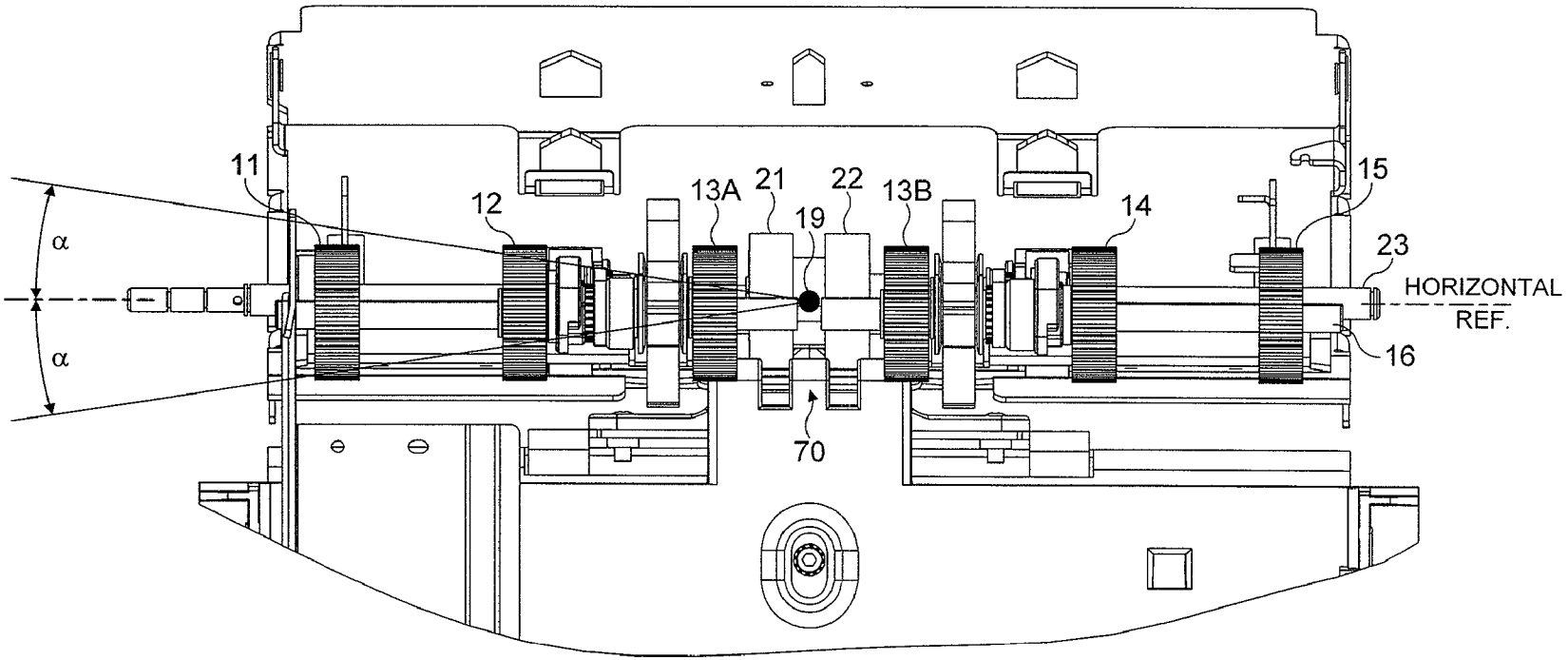
FIG. 8 is a front view of the embodiment of FIGS. 1 to 7 detailing rotation of the feeding mechanism relative to the supporting structure.

As seen in FIG. 5, the full stack of sheets is raised on the platform 50 until the top sheets are brought into contact with the pre-feed system 10. As indicated in FIGS. 4 and 8, the sheet feeder 1 is provided with a sensor 70 mounted in line with the leading edge of the stack of sheet material on the platform 50. This detection sensor dictates the level to which the platform is raised when providing the sheet material to the pre-feed section 10. The position of the sensor 70 relative to the separator 20 is fixed. This sensor stops the platform 50 from rising when it senses the sheet material on the platform. This ensures accurate positioning of the sheet material before feeding. The detection sensor 70 is positioned as close as possible to the centre of the lead edge of the sheet material to give the best position from which to start feeding. Further, the separator system 20 should be as close as possible to the detection sensor 70 so that when the detection sensor 70 is actuated, the sheet material lead edge position is exactly known relative to the separator 20, even when dealing with curled material.

The pre-feed section 10 is biased downwards onto the stack, causing the top-most sheet in the stack to become flattened at the leading edge, as shown in FIG. 5. This ensures that, even for very thick stacks of several hundred envelopes, the pre-feed section 10 will maintain an even contact along the leading edge of the top sheet, even when the sheet is excessively curved when uncompressed. This compression of the sheets in the stack helps to remove deformities in the stack shape caused by folds, bends, seams, staples, etc in the sheet material, and also helps to reduce any amounts of trapped air between adjacent sheet components in order to create a level surface of contact between the sheets and the pre-feed rollers 11 to 15.

The compression force from the pre-feed section 10 can be controlled accurately either through precisely controlling the weight of the pre-feed section 10 to ensure that a pre-determined compression force under gravity is achieved, or by using a system of compression springs to increase or decrease the effective weight of the pre-feed system 10 acting upon the stack of sheets on the platform 50.

To ensure that the sheets are fed smoothly, the end rollers 11, 15 are preferably located on the very edge of the material. As such, the rollers are linked to the side guides 60 to enable sliding along the pre-feed shaft 16 following any side-guide adjustments, and ensuring contact with the side edges of the sheet material. When resting on the top of the stack of material, the pre-feed system 10 has to be as close as possible to the material lead edge. The pre-feed system 10 has two main roles. The first is to flatten the stack, and the second is to drive the sheet material towards the separator. Being close to the sheet's leading edge aids compression of the stack at the leading edge, thus improving the directional feeding accuracy of pre-feed system 10.

In order to further enhance the contact between the pre-feed section 10 and the stack of sheets supported by the platform 50, the pre-feed section 10 is mounted in a manner allowing several controllable degrees of freedom in order to allow a smooth contact to be established with the top sheet in the stack. As shown in FIG. 8, the pre-feed shaft 16 can rotate around a central pivot 19 about an axis substantially in the sheet-feed direction. The pre-feed section is able to rotate about this axis by an angle $\alpha$ in either direction (see FIG. 8). This allows the pre-fed section 10 to align with the top sheet in the stack supported by the platform 50 even when the leading edge of the sheet is not entirely level. Although not shown, the pre-feed section 10 may also be rotated around a horizontal axis parallel to or coincident with the rotational axis of the separator shaft 23, to accommodate any differences in the type or construction of the sheets being fed, and to ensure a smooth and direct feed to the separation section 20. Slots 63 (FIG. 3) are provided in the side guides 60 to allow this arcuate motion, which controls the proximity of the pre-feed rollers to the leading edge of the top sheet, as well as the exact vertical position of the pre-feed shaft 16.

Turning back to FIG. 3, the side guides 60 are further described. Each side guide 60 consists of a central planar vertical column 64 which defines an edge of the storage chamber 2. At the sides of the storage chamber 2 corresponding to the rear of the stack of sheets to be fed into the sheet handling apparatus, each side guide 60 has a back wing 62. Each back wing is angled along lower edge 62A, to easily receive sheets on top of the stack between back wings 62 as the platform is raised. The back wings 62 guide the rear end of the sheets as they are fed by the pre-feed section 10 to the separation section 20. This ensures that the sheets will be fed with the front edge correctly aligned and helps to maintain an even driving force across the sheet as it is fed by the pre-feed section 10 into the separation section 20. At the top front end of each guide section 60 is provided a funnel region 61 comprising an upper guide component 61B and lower guide component 61A. Lower and upper guide components 61A and 61B contact the leading edges of the sheets being fed into the separator section at the sides (left and right) of the sheets to ensure that the side edges of the sheets at the leading edge are guided correctly into the separator section 20 when fed by the pre-feed section 10. This helps to accommodate any variations in vertical alignment of the edge regions of the sheets in the stack in overhang regions H1 and H2 (FIG. 6). Such variations may occur, for example, due to differences in the material stiffness of different sheets fed from the stack to the separator 20.

Thus, if a stack is produced which is still slightly upwardly-curled in the corner edges, funnel section 61B will force the corner edge down and into the correct feed path when fed by the pre-feed section 10, whilst if any edge corners are drooping too much, funnel section 61A guides the front end region upwards and into the separation section 20. The location of the side guide 60 relative to the other components of the feed section 10 and separation section 20 can be seen in FIG. 7 where a sheet 85 is shown being fed into the funnel section 61 of the side guide 60.

The side guide "funnels" are used to level pre-fed material so that the material is flat when it enters the separator. The opening angle of each funnel is set so that the worst-case curled material expected to be fed can be driven in (without material stubbing on the funnel). Funnels are used in conjunction with the platform/pre-feed elements to finish flattening materials. Funnels can also be useful to feed the last material of a stack as material edges will hang below the platform. The back wings located on the top of the guides, increase guidance of the back of the material. The fact that the side guides widen under the wings helps to load the feeder more easily and quickly. This also reduces material friction on the side guides when the platform is raised, reducing the size of the motor required to lift the platform as contact between the guides and stack is reduced.

In order to cope with variations in the sheet material being fed from the stack, i.e. from one type and size of sheet material to another, side guides 60 are movable laterally towards and away from one another, to thereby narrow or widen the effective width of the storage chamber 2. In this way, the same sheet feeder becomes capable of feeding a range of different sizes of media therefrom, thus improving the adaptability and functionality of the feeder.

As described hereinbefore, the normal from the pre-feed rollers 11 to 15 upon the top sheet in the stack is determined by the pre-feed section 10. However, the pre-feed section could alternatively be maintained stationary whilst the platform 50 is biased upwards towards the pre-feed rollers 11 to 15 by appropriate counter-balancing or motor technology.

Although not shown in the Figures, the platform 50 may also have a lowered front section, equivalent to lowered side sections 52 and 53, for allowing an overhang at the front region of the stack.

The arrangement allows for the feeding of thin material (envelopes, sheets, pre-folded inserts, booklets, etc.), from the top of a stack, providing a fast throughput, high capacity (in excess of 300 envelopes), a very high reliability (proven by formal test where 1 fault in 70k cycles was achieved) whilst maintaining a very compact footprint.

The stacker can feed material, even very curled or puffed (material containing trapped air), thanks to the combination of the components. The platform 50 and the pre-feed system 10 flatten the material to be fed, as the Pre-feed shaft 16 applies a defined normal force on the top of the stack. Funnels form part of the side guides 60 and are present to guide the material lead edge through a narrow path into the separator 20. The funnels reduce the pre-fed material height variations along the lead edge so that when the material lead edge enters the separator 20 the material is relatively flat and controlled between the side guides, preventing the material from jamming or having excessive skew.

This system operates by feeding from the top of the stack, firstly by flattening top of stack using a narrow platform 50 and a pre-feed system 10 and secondly by driving the material lead edge, which is about to be fed, through funnels 61 (part of the side guides 60) to finish flattening the material in order to thereby obtain better control on feeding.

Whilst the above embodiment finds particular application to envelope feeders, it is to be noted that the invention is also applicable to all sheet feeders, and especially to sheet feeders for feeding awkwardly-curled stacks of sheet material, such as folded or stapled sheets, or sheet material having air trapped in the stack.

As will be apparent to those skilled in the art, rotation of the separator system 20 about the central axis parallel to the sheet feed direction, as described above, could be effected by alternative means. For example, the axis need not be centrally located.

Whilst the above-detailed embodiment utilises a combination of features, such as the specifically-shaped and dimension platform 50, the back wings, for guiding sheets being fed from the trailing edge, the funnel sections, for guiding the leading edge of sheets fed to the separator section and the compressive and adjustable pre-feed section 10, it is to be noted that each component and each function individually provides an advantage in terms of sheet-feeding accuracy, centred on the principle of producing a flattened and guided leading edge of the top sheets in the stack of sheet materials to be fed.

Similarly, the corrugated separator described herein is not critical to the construction of sheet feeders according to the present invention, and any suitable separator system could be used in conjunction with the further features of the sheet feeding apparatus described above.

What is claimed is:

1. A sheet stacking apparatus for storing a plurality of sheets, comprising:

a storage chamber;

a platform located within the storage chamber for storing a plurality of sheets in a substantially vertical stack thereon, the platform having a central lift plate and lowered side plates integrally formed with the central lift plate, each of the lowered side plates, furthermore, disposed to a side of the central lift plate and having a portion which extends rearwardly of the central lift plate, the central lift plate and lowered side plates defining (i) a void region disposed forwardly of each side plate and to each side of the central lift plate, and (ii) a support region disposed aft and to each side of the central lift plate;

a feeder for feeding a top sheet from the stack; and an actuation mechanism operative to move the platform upwards and hold the stack in operative contact with the feeder;

the central lift plate and lowered side plates of the platform supporting sheets of varying size such that portions thereof may be allowed to droop below the lift plate in either the void or support regions.

2. The sheet stacking apparatus according to claim 1, wherein the storage chamber comprises left and right side guides, at least one of which is adjustable to alter the width of the storage chamber.

3. The sheet stacking apparatus according to claim 2 wherein the at least one of the guides traverse into the respective void region of the platform.

4. The sheet stacking apparatus according to claim 1 wherein the platform is movable between a full position at the bottom of the storage chamber to an empty position at the top of the storage chamber, and wherein the feeder comprises:

a pre-feed system disposed above the stack and in combination with the storage chamber, the pre-feed system adapted to engage and shingle sheets received from the top of the stack; and separation means for engaging sheets shingled by the pre-feed system to remove sheets one-at-a-time from the stack.

5. The sheet stacking apparatus according to claim 4, further comprising a sensor for detecting the presence of sheets in the stack to thereby control the position of the platform between the full position and the empty position.

6. The sheet stacking apparatus according to claim 4, wherein the pre-feed system is configured and arranged to pressingly engage the top of the stack of sheets to apply a substantially vertical compressive force to the stack to achieve a substantially uniform contact force across the width of the sheet.

7. The sheet stacking apparatus according to claim 4, wherein the pre-feed system is mounted to have a rotational degree of freedom about an axis substantially parallel to the feeding direction of sheets being fed from the pre-feed system to the separation means for allowing the pre-feed system to align with the top sheet in the stack.

8. The sheet stacking apparatus according to claim 4, wherein the pre-feed system is mounted to be movable in an arcuate path about a horizontal axis substantially perpendicular to the feeding direction of sheets being fed from the pre-feed system to the separation means for effecting vertical and lateral translation of the pre-feed system relative to the apparatus.

9. The sheet stacking apparatus according to claim 4, wherein the pre-feed system comprises one or more pre-feed rollers on a pre-feed shaft.

10. The sheet stacking apparatus according to claim 9, wherein the lateral position of at least one of the one or more pre-fed rollers on the pre-feed shaft is adjustable for allowing the rollers to be aligned with the side edges of sheets in the stack.

11. The sheet stacking apparatus according to claim 4 wherein the storage chamber includes adjustable side guides, the side guides being disposed to each side of the storage chamber and operative to be received within the void regions of the platform, each side guide furthermore including a guide funnel operative to receive and guide a leading side edge of the sheets and ensure that sheets, fed from the pre-feed system, are vertically aligned with the separation means.

12. The sheet stacking apparatus according to claim 11 wherein each side guide further includes back wings disposed rearwardly of the guide funnels, each back wing operative to receive and guide a trailing side edge of the sheets and ensure that sheets, fed from the pre-feed system, are laterally aligned with the separation means.

13. The sheet stacking apparatus according to claim 12 wherein the platform defines overhang regions to each side of the central lift plate and above the lowered side plates, and wherein each guide funnel includes upper and lower guide components operative to guide the leading side edges of the sheets drooping into the overhang regions of the platform.

14. The sheet stacking apparatus according to claim 11 wherein the platform defines overhang regions to each side of the central lift plate and above the lowered side plates, and wherein each guide funnel includes upper and lower guide components operative to guide the leading side edges of the sheets drooping into the overhang regions of the platform.

15. The sheet stacking apparatus according to claim 1 wherein the platform includes a first width dimension W1 measured between the external side edges of each lowered side plate, and a second width dimension W2 measured between the external side edges of the central lift plate, and wherein the second width dimension divided by the first width dimension defines a width ratio W2/W1, the width ratio being about 0.56 to accommodate a variety of sheet sizes.

16. The sheet stacking apparatus according to claim 1 wherein the platform includes a first length dimension L1 measured between a forward edge of the central lift plate to a rear edge of the lowered side plates, and a second length dimension L2 measured between the forward edge of the central lift plate to a forward edge of each lowered side plate wherein the second length dimension divided by the first length dimension defines a length ratio L2/L1, the length ratio being about 0.43 to accommodate a variety of sheet sizes.

17. The sheet stacking apparatus according to claim 1 wherein the platform includes a first width dimension W1 measured between the external side edges of each lowered side plate, and a second width dimension W2 measured between the external side edges of the central lift plate, wherein the platform includes a first length dimension L1 measured between a forward edge of the central lift plate to a rear edge of the lowered side plates, and a second length dimension L2 measured between the forward edge of the central lift plate to a forward edge of each lowered side plate, wherein the second width dimension divided by the first width dimension defines a width ratio W2/W1, the width ratio being about 0.56 and wherein the second length dimension divided by the first length dimension defines a length ratio L2/L1, the length ratio being about 0.43, the width and length ratios accommodating a variety of sheet sizes.

* * * * *